US006778204B2

(12) United States Patent
Morita

(10) Patent No.: US 6,778,204 B2
(45) Date of Patent: Aug. 17, 2004

(54) IMAGE RECORDING DEVICE

(75) Inventor: Seiki Morita, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 10 days.

(21) Appl. No.: 10/252,355

(22) Filed: Sep. 24, 2002

(65) Prior Publication Data

US 2003/0058331 A1 Mar. 27, 2003

(30) Foreign Application Priority Data

Sep. 26, 2001 (JP) ..... 2001-293561

(51) Int. Cl.[7] ..... B41J 2/435; B41J 27/00
(52) U.S. Cl. ..... 347/248; 347/257
(58) Field of Search ..... 347/238, 241, 347/234, 248, 256, 242, 257

(56) References Cited

U.S. PATENT DOCUMENTS 6,522,350 B2 * 2/2003 Inoue et al. ..... 347/238
2003/0137580 A1 * 7/2003 Sumi et al. ..... 347/243

FOREIGN PATENT DOCUMENTS

JP 2002098925 A * 4/2002 ..... G02B/26/10

* cited by examiner

*Primary Examiner*—Hai Pham
(74) *Attorney, Agent, or Firm*—Sughrue Mion, PLLC

(57) ABSTRACT

An image recording device equipped with a focal point adjusting mechanism is provided. Displacement of the focal point of a light beam emitted from a recording head in correspondence with the traveling amount of the recording head in the axial direction of a drum is measured in advance after the image recording device has been assembled. Correction data for compensation of the displacement is prepared from the measured amount of displacement and stored in a correction table. At the time of image recording, the focal length is corrected by reading out the correction data from the correction table in response to the traveling amount of the recording head and moving a moving stage in the direction of the optical axis. Therefore, slight displacement of the focal point, which may compromise image quality, can be compensated with a simple device.

15 Claims, 10 Drawing Sheets

IMAGE RECORDING DEVICE

BACKGROUND OF THE INVENTION

1. Field of the Invention

The present invention relates to an image recording device in which an image is recorded on a printing plate precursor wound around a peripheral surface of a rotating drum, by moving a recording head in the axial direction of the rotating drum while the rotating drum is rotated at a predetermined speed, with the recording head being disposed facing the peripheral surface of the rotating drum and including an optical system that irradiates the printing plate precursor with a light beam modulated on the basis of image data.

2. Description of the Related Art

Devices for exposing printing plate precursors have been developed in which, using sheet-like recording material, and particularly a printing plate precursor comprising a support having disposed thereon a photosensitive layer, an image is recorded with a laser beam or the like directly on an emulsion surface that is a recording layer of the printing plate precursor, by winding the printing plate precursor around a rotating drum and moving a recording head in the axial direction of the rotating drum (sub-scanning) while the rotating drum is rotated at a high speed (main scanning). With such technology, it has become possible to quickly record an image on a printing plate precursor.

The laser beam is controlled by an optical system so that diffused light emitted from an emission point in the recording head converges and is focused at a predetermined focal point position. The focal point position lies on an image recording surface of the printing plate precursor wound around the peripheral surface of the rotating drum. Theoretically, the focal length is such that the focal point stays on the image recording surface of the printing plate precursor as long as the rotating drum rotates without displacing its own axis and the recording head moves along the axis of the rotating drum.

In actuality, however, while the recording head moves along a ball screw shaft, the relative position of the recording head with respect to the rotating drum may vary due to flexion of the shaft. As a result, the laser beam may fall outside the ideal range of the focal depth, whereby image quality is compromised.

In order to solve this problem, it has been proposed to employ an auto-focus device for monitoring the relative position of the recording head with respect to the rotating drum and adjusting the focal length.

An auto-focus device comprises, in the case of triangulation, a laser diode (LD) light source, which is relatively powerful and has a small beam diameter, and a photosensitive diode (PSD) that electrically detects the displacement of the focal point of light, which is emitted from the LD light source and reflected on the printing plate precursor, the displacement of the focal point of light being caused due to the displacement of the printing plate precursor in the thickness direction thereof, and the auto-focus device is complicated and expensive.

SUMMARY OF THE INVENTION

In view of the aforementioned circumstances, an object of the present invention is to provide an image recording device in which variation in focal length due to fluctuation in the relative position of a recording head with respect to a rotating drum can be compensated without using an auto-focus device or the like to detect in real time the focal point of a light beam.

A first aspect of the invention is a device for recording an image on a sheet-like recording material in accordance with image data, the device comprising: a rotatably supported drum including a peripheral surface on which the sheet-like recording material is wound; a recording head including an optical unit that receives the image data and irradiates the sheet-like recording material with a light beam modulated on the basis of the image data to record an image on the sheet-like recording material, the recording head disposed facing the peripheral surface of the drum and movable in the axial direction of the drum; a traveling amount detector for detecting a traveling amount of the recording head in the axial direction thereof from a predetermined position; a memory for storing data for compensating for displacement of the optical unit in the direction of the optical axis in correspondence with the traveling amount of the recording head; and a focal point adjusting mechanism for adjusting the focal point of the light beam by moving at least a part of the optical unit included in the recording head in the direction of the optical axis, wherein the focal point adjusting mechanism corrects the focal point based on the traveling amount of the recording head detected by the traveling amount detector, and on the data for compensating for displacement of the optical unit in the direction of the optical axis stored in the memory, in correspondence with the traveling amount of the recording head. The traveling amount detector may include a rotational position detector which detects the rotational position of the drum.

The traveling amount of the recording head in the axial direction of the rotating drum may be computed based on a signal outputted for each predetermined number of drum rotations by the traveling amount detector.

Further, data for compensating the displacement of the optical unit in the direction of the optical axis stored in the memory in accordance with the traveling amount of the recording head may be measured and stored before starting the image recording.

According to the first aspect of the present invention, displacement of the focal point of the light beam is measured in advance by moving the recording head parallel to the axis of the rotating drum while rotating the rotating drum after the device of the present embodiment is assembled. Then, based on the displacement of the focal point of the light beam, the data for compensating the displacement of the optical unit in the direction of the optical axis is prepared and stored in the memory.

The focal point adjusting mechanism is controlled so as to correct the focal point based on the data for compensating the displacement in the direction of the optical axis.

In the first aspect of the present invention, because the displacement of the focal length is measured in advance after the device is assembled, correction of the focal point can, to some extent, be conducted. Although the accuracy of the correction in the first aspect of the present invention is lower than that of real-time correction, (in which the displacement of the focal point is measured and corrected for each scan-exposing) displacements in focal points can be sufficiently compensated using a simple structure while maintaining image quality.

The first aspect of the present invention may further include a non-image recording area recognizing means which recognizes a non-image recording area on the rotating drum based on the rotational position of the rotating drum detected by the rotational position detector. In this case, the focal point is corrected when the recording head faces the non-image recording area for each predetermined number of rotations.

When an image is recorded, the non-image recording area on the rotating drum is recognized based on the rotational position of the drum, which is detected by the rotational position detector. Because the sheet-like recording material is held by, for example, chucks at both leading and trailing ends thereof, the peripheral surface of the rotating drum has non-image recording areas which include at least the portions where the chucks are provided. The focal point adjusting mechanism is controlled so as to adjust the focal point based on the data for compensating the displacement in the direction of the optical axis on the non-image recording area for each predetermined number of rotation of the rotating drum.

Further, the focal point adjusting mechanism may adjust the focal point by changing the relative position of the entire optical unit in relation to the rotating drum.

In this case, because the entire optical unit is moved to change the position relative to the rotating drum, it becomes unnecessary to consider variation or deformation in the focal spot diameter. Thus the image quality can be stabilized as compared to a case in which the focal length is adjusted by moving a part of the lenses in the optical unit.

The image recording device of the first aspect of the present invention may further include a temperature detector provided on or near the recording head. In this case, a correction coefficient based on temperature readings detected by the temperature detector supplements the data for compensating the displacement of the optical unit in the direction of the optical axis.

During operation, the temperature may change in the vicinity of the recording head. When the detected temperature differs from that preset in the data for compensating the displacement of the optical unit in the direction of the optical axis, the difference may be used as a correction coefficient and calculated in the data to make the correction even more accurate.

DESCRIPTION OF THE PREFERRED EMBODIMENTS

First Embodiment

Figure 1:
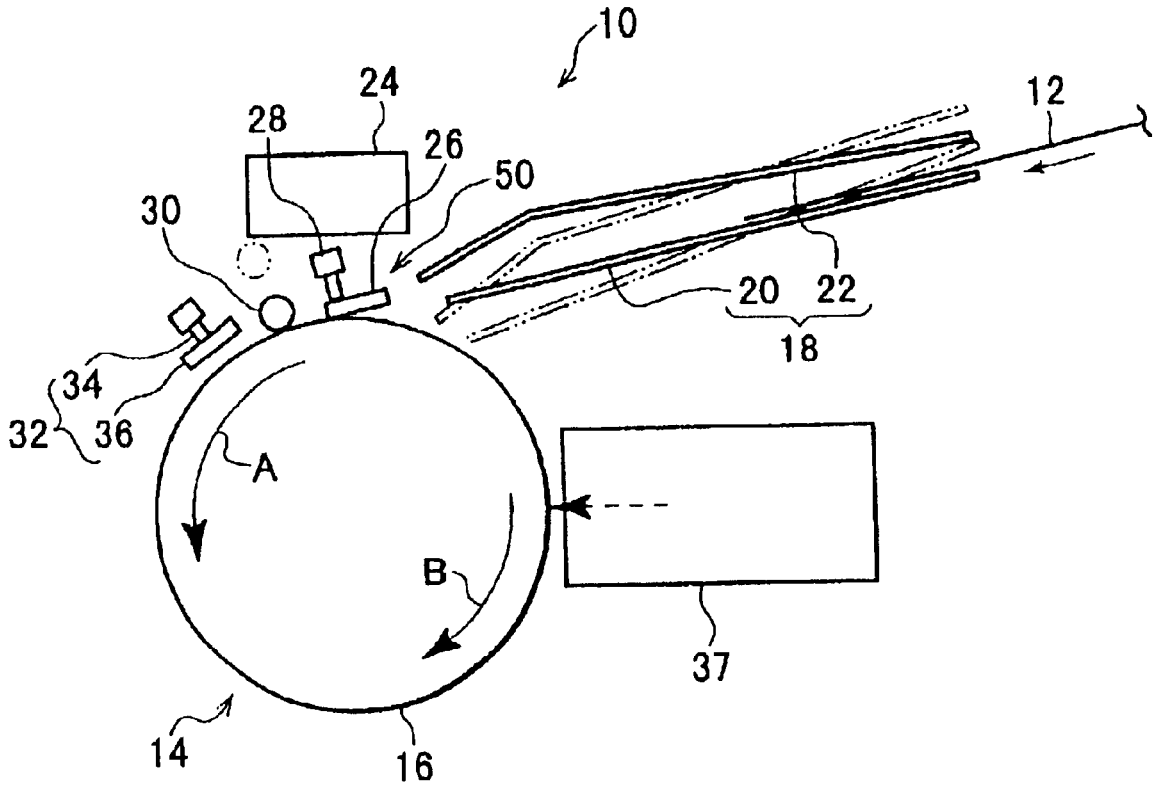
FIG. 1 is a schematic view of a device for automatically exposing printing plate precursors relating to a first embodiment of the present invention.

FIG. 1 shows a device 10 for automatically exposing printing plate precursors relating to a first embodiment of the present invention.

The device 10 is divided into two blocks: an exposure section 14 that irradiates an image forming layer of a printing plate precursor 12 with a light beam to thereby expose an image; and a conveyance guide unit 18 that conveys the printing plate precursor 12 to the exposure section 14. Once the printing plate precursor 12 has been exposed by the device 10, the printing plate precursor 12 is fed to an unillustrated developing apparatus disposed adjacent to the device 10.

The exposure section 14 includes, as a main component, a rotating drum 16 that has a peripheral surface around which the printing plate precursor 12 is wound and held. The printing plate precursor 12 is guided by the conveyance guide unit 18 and fed to the rotating drum 16 from a direction tangential to the rotating drum 16. The conveyance guide unit 18 includes a feeding guide 20 and a discharging guide 22.

The feeding guide 20 and the discharging guide 22 are positioned relative to each other such that they form a lateral V-like shape, and pivot at a predetermined angle about a vicinity of the center of FIG. 1. The feeding guide 20 and the discharging guide 22 can be pivoted so that their respective mounting surfaces (i.e., surfaces on which the printing plate precursor 12 is mounted) can be selectively positioned in a direction substantially tangential to the rotating drum 16.

A puncher 24 is disposed in the vicinity of the conveyance guide unit 18 and punches through holes in the printing plate precursor 12 that are used as a reference when the printing plate precursor 12 is wound around a plate drum of a rotary press (not shown). By facing the feeding guide 20 towards the puncher 24, the leading end of the printing plate precursor 12 can be fed to the puncher 24. Namely, the printing plate precursor 12 is first guided by the feeding guide 20 and fed to the puncher 24. After a hole (e.g., a round or long hole) is punched in the leading end of the printing plate precursor 12, the printing plate precursor 12 is temporarily returned to the feeding guide 20. Thereafter, the conveyance guide unit 18 is rotated, and the printing plate precursor 12 is moved to a position corresponding to the rotating drum 16.

Figure 2:
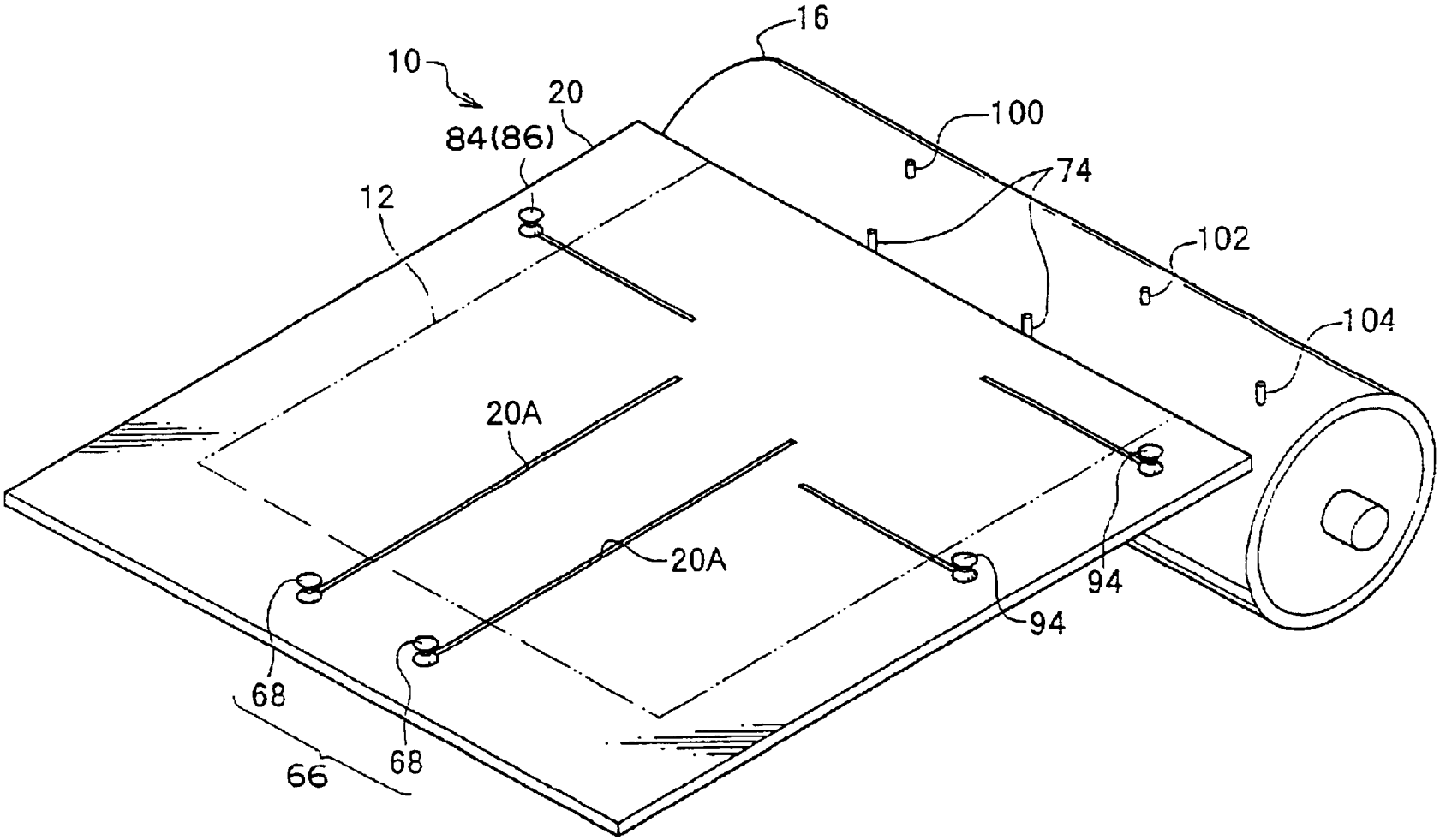
FIG. 2 is a perspective view of a conveyance guide unit from which a discharging guide has been removed, with a printing plate precursor being provisionally aligned on a feeding guide.

FIG. 2 shows the conveyance guide unit 18 with the discharging guide 22 having been removed therefrom (i.e., so that the conveyance guide unit 18 is disposed only with the feeding guide 20).

Pressing portions 68 (a pressure unit 66) are disposed near an end (i.e., the end in FIG. 2 closest to the viewer) of the feeding guide 20 that is opposite from an end disposed near the rotating drum 16. Each pressing portion 68 is rotatably supported on a support axis (not shown) that passes through a pair of slits 20A toward the back surface (i.e., the undersurface) of the feeding guide 20.

A pair of retractable aligning pins 74 that correspond to the pressing portions 68 is provided at the end of the feeding guide 20 disposed near the rotating drum 16.

The aligning pins 74 can be positioned in two positions: a protruded position, in which they protrude higher than the mounting surface of the feeding guide 20, and a retracted position, in which they are retracted lower than the mounting surface of the feeding guide 20.

A widthwise pressing portion 86 (a widthwise pusher unit 84) is disposed near one widthwise end of the feeding guide 20 (i.e., near the left side in FIG. 1). The widthwise pressing portion 86 moves along the axial direction of the rotating drum 16 and is rotatably supported on a support axis (not shown) that passes through a slit 20B toward the back surface (i.e., undersurface) of the feeding guide 20.

The widthwise pressing portion 86 is movable parallel to the axial direction of the rotating drum 16 along the slit 20B that extends in the axial direction of the rotating drum 16, as shown in FIG. 2.

As shown in FIG. 2, a pair of aligning pin units is disposed near the other widthwise end of the feeding guide 20 (i.e., near the right side of FIG. 2). The aligning pin units are movable along the axial direction of the rotating drum 16.

Each of the aligning pin units is formed by an aligning pin 94 disposed on the mounting surface (upper surface) of the feeding guide 20 and a support axis (not shown) on which the aligning pin 94 is rotatably supported. The support axis passes through a pair of slits 20C toward the back surface (i.e., undersurface) of the feeding guide 20.

As shown in FIG. 2, the slits 20C extend parallel to each other in the axial direction of the rotating drum 16, so that the aligning pins 94 are movable along the slits 20C in the axial direction of the rotating drum 16 and disposed at positions predetermined in accordance with the size of the printing plate precursor 12.

The rotating drum 16 is rotated by a driving means (not shown) in two directions: the direction in which the printing plate precursor 12 is mounted on the rotating drum 16 and exposed (i.e., the direction of arrow A in FIG. 1) and the direction in which the printing plate precursor 12 is removed (i.e., the direction of arrow B in FIG. 1).

As shown in FIG. 1, a leading end chuck 26 is attached at a predetermined position on the outer peripheral surface of the rotating drum 16. When the printing plate precursor 12 is to be mounted on the rotating drum 16, the rotating drum 16 stops rotating when the leading end of the printing plate precursor 12 fed by the feeding guide 20 reaches a position at which the leading end faces the leading end chuck 26 (printing plate precursor mounting position).

A mounting cam 28 is provided so as to face the leading end chuck 26 at the printing plate precursor mounting position. The mounting cam 28 pivots and presses one end of the leading end chuck 26 so that the printing plate precursor 12 can be inserted between the leading end chuck 26 and the peripheral surface of the rotating drum 16.

Once the leading end of the printing plate precursor 12 has been inserted between the leading end chuck 26 and the rotating drum 16, the mounting cam 28 is returned to its former position and the leading end chuck 26 is released. The leading end of the printing plate precursor 12 is thus nipped between the leading end chuck 26 and the peripheral surface of the rotating drum 16.

At this time, the leading end of the printing plate precursor 12 abuts against a pair of aligning pins 100 and 102 protruding from the peripheral surface of the rotating drum 16 at predetermined positions. Additionally, one widthwise end of the printing plate precursor 12 abuts against an aligning pin 104 protruding from the peripheral surface of the rotating drum 16 near one axial-direction end of the rotating drum 16. Accordingly, the printing plate precursor 12 is properly aligned on the rotating drum 16.

After the leading end of the printing plate precursor 12 is fixed on the rotating drum 16, the rotating drum 16 is rotated in the direction of arrow A, whereby the printing plate precursor 12 fed from the feeding guide 20 is wound around the peripheral surface of the rotating drum 16.

A squeeze roller 30 is disposed downstream in the direction of arrow A from the printing plate precursor mounting position, in the vicinity of the peripheral surface of the rotating drum 16. The squeeze roller 30 moves towards the rotating drum 16 and presses the printing plate precursor 12 wound around the rotating drum 16 towards the rotating drum 16, so that the printing plate precursor 12 is set in close contact with the peripheral surface of the rotating drum 16.

A trailing end chuck mounting/dismounting unit 32 is downstream in the direction of arrow A from the squeeze roller 30, in the vicinity of the rotating drum 16. The trailing end chuck mounting/dismounting unit 32 is formed by a shaft 34, which protrudes towards the rotating drum 16, and a trailing end chuck 36, which is mounted to an end of the shaft 34.

When the trailing end of the printing plate precursor 12 reaches a position at which it faces the trailing end chuck mounting/dismounting unit 32, the shaft 34 is extended so that the trailing end chuck 36 is mounted at a predetermined position on the rotating drum 16. The trailing end of the printing plate precursor 12 is thus nipped between the trailing end chuck 36 and the peripheral surface of the rotating drum 16.

Once the leading and trailing ends of the printing plate precursor 12 are held on the rotating drum 16, the squeeze roller 30 is moved away from the printing plate precursor 12. Then, while the rotating drum 16 is rotated at a predetermined high rotational speed, a light beam that has been modulated on the basis of image data is irradiated from a recording head 37 in synchronization with the rotation of the rotating drum 16. In this manner, the printing plate precursor 12 is scan-exposed on the basis of the image data.

Figure 4A:
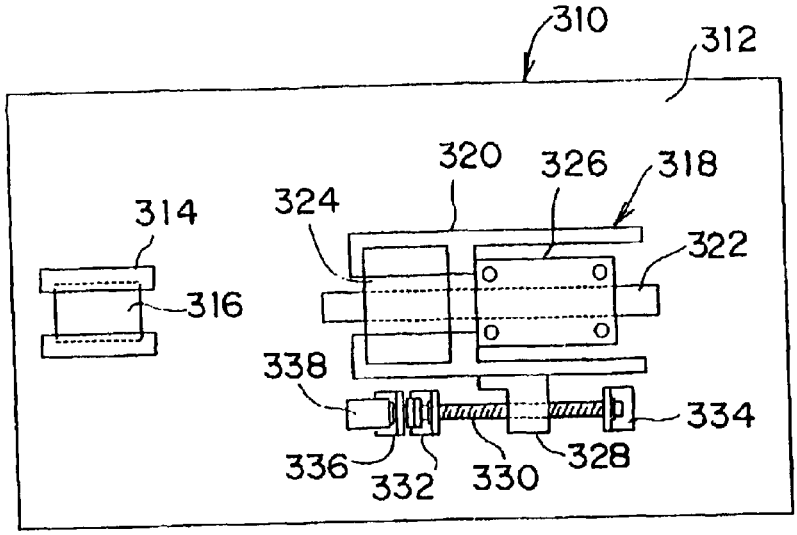
FIG. 4A is a plan view of a head unit mounted on a recording head relating to the first embodiment of the invention.
Figure 4B:
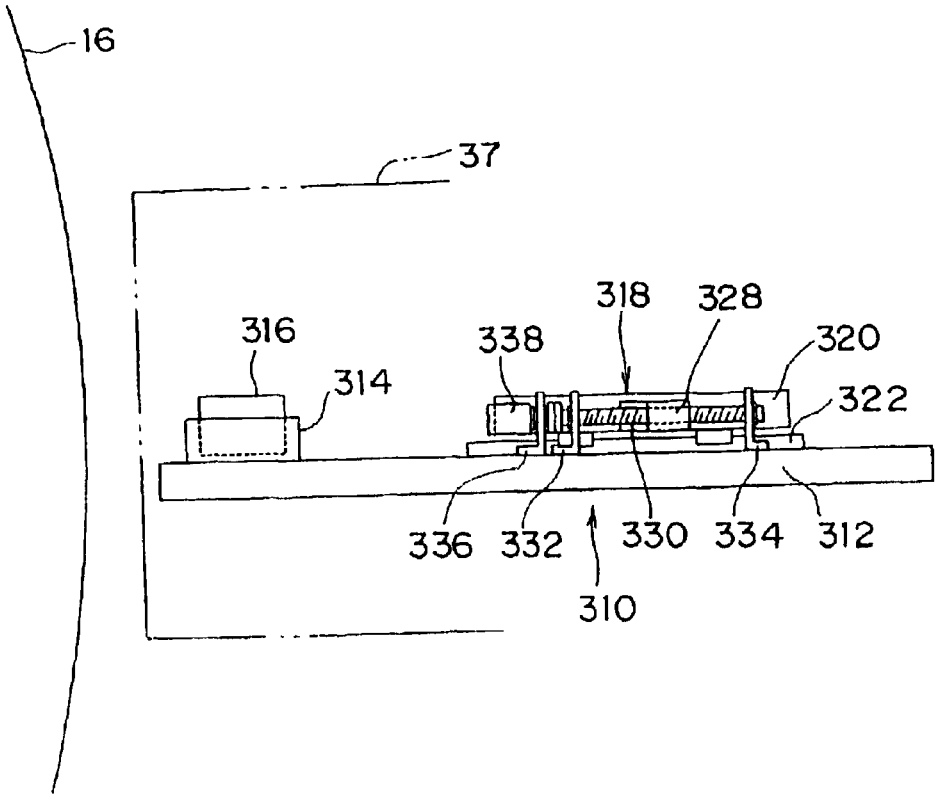
FIG. 4B is a side view of the head unit.

FIGS. 4A and 4B illustrate in detail the structure of a head unit 310 mounted on the recording head 37.

The head unit 310 includes a base 312 on which a condenser lens 316 is fixedly attached via a bracket 314 in the vicinity of the end of the base 312 disposed near the rotating drum 16. Light emitted from a light-emitting unit 318 enters the condenser lens 316 and is focused on the image recording surface of the printing plate precursor 12 wound around the rotating drum 16.

The light-emitting unit 318 includes a moving stage 320 that is smoothly slidable on a rail 322 with respect to the base 312. The moving stage 320 is thus movable with respect to the base 312 towards and away from the rotating drum 16.

A collimator lens 324 is disposed on the moving stage 320 so as to face the condenser lens 316, and a fiberoptic source 326 is disposed adjacent to the collimator lens 324. The fiberoptic source 326 emits light that has been guided to the fiberoptic source 326 via a fiber cable 122 from a light source unit 110 provided separately from the recording head 37 (See FIG. 9).

Figure 9:
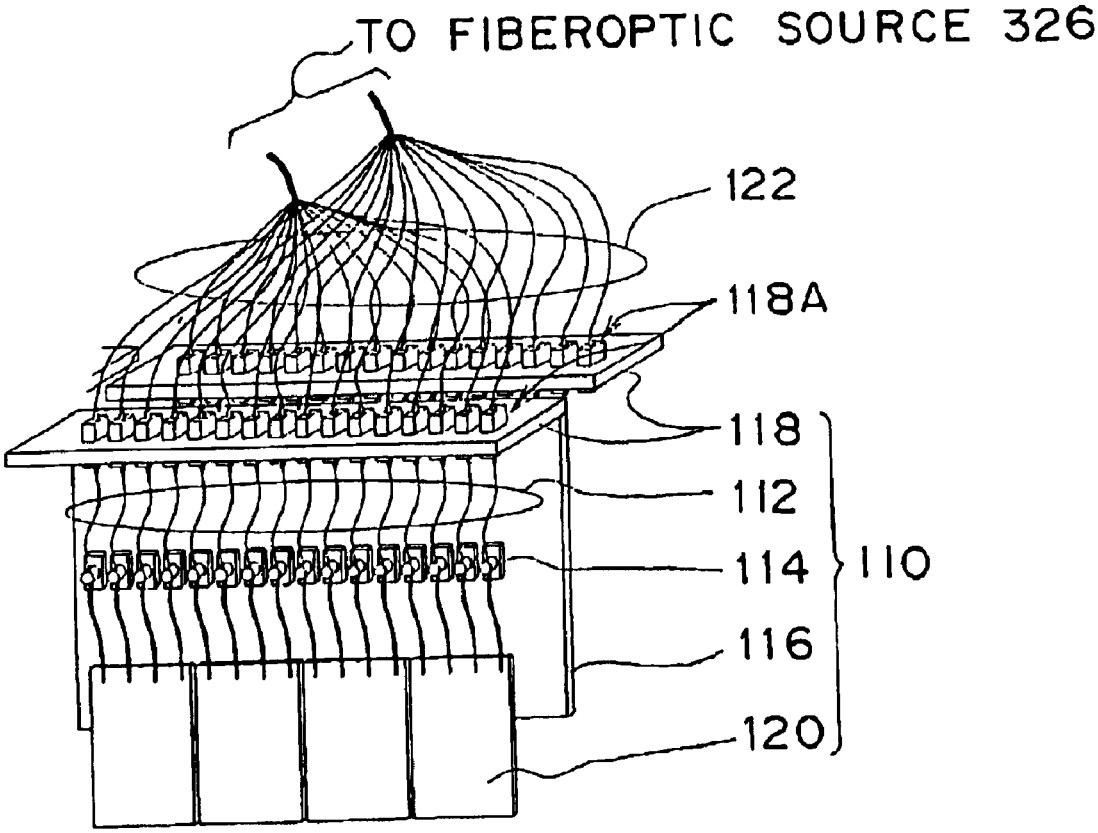
FIG. 9 is a perspective view illustrating in detail the structure of a light-emitting unit.

As shown in FIG. 9, the light source unit 110 is formed by a light source substrate 116, a LD driver substrates 120, and an adapter substrates 118. A plurality of broad-area semiconductor lasers 114 is mounted on the front surface of the light source substrate 116 and a heat radiating fin (not shown) is provided on the rear surface of the light source substrate 116. Each of the semiconductor lasers 114 is coupled with an end of an optical fiber 112. A plurality (the same number as those of the semiconductor lasers 114) of adapters of SC-type optical connectors 118A are mounted on the adapter substrates 118. The adapter substrates 118 are horizontally fixed at an end of the light source substrate 116. The semiconductor lasers 114, which are horizontally provided at the other end of the light source substrate 116, are driven by a LD driver circuit in accordance with image data of the image to be recorded on the printing plate precursor 12.

At the other end of each optical fiber 112, there is provided a plug of the SC-type optical connector 118A that is fitted into one insertion opening of each adapter provided on the adapter substrate 118. Accordingly, a laser beam emitted from each of the semiconductor lasers 114 is transmitted by the optical fiber 112 to the substantial mid position of the adapter provided on the adapter substrate 118.

Output terminals for outputting signals for driving the semiconductor lasers 114 are provided on the LD driver circuit and each of the output terminal is connected to each semiconductor laser 114. Driving of each semiconductor laser 114 is controlled by the LD driver circuit.

Laser beams emitted from the semiconductor lasers 114 are sent to the fiberoptic source 326 via the fiber cables 122. At one end of each fiber cable 112, there is provided a plug of a SC-type optical connector that is fitted into the other insertion opening of each adapter provided on the adapter substrate 118.

Figure 10:
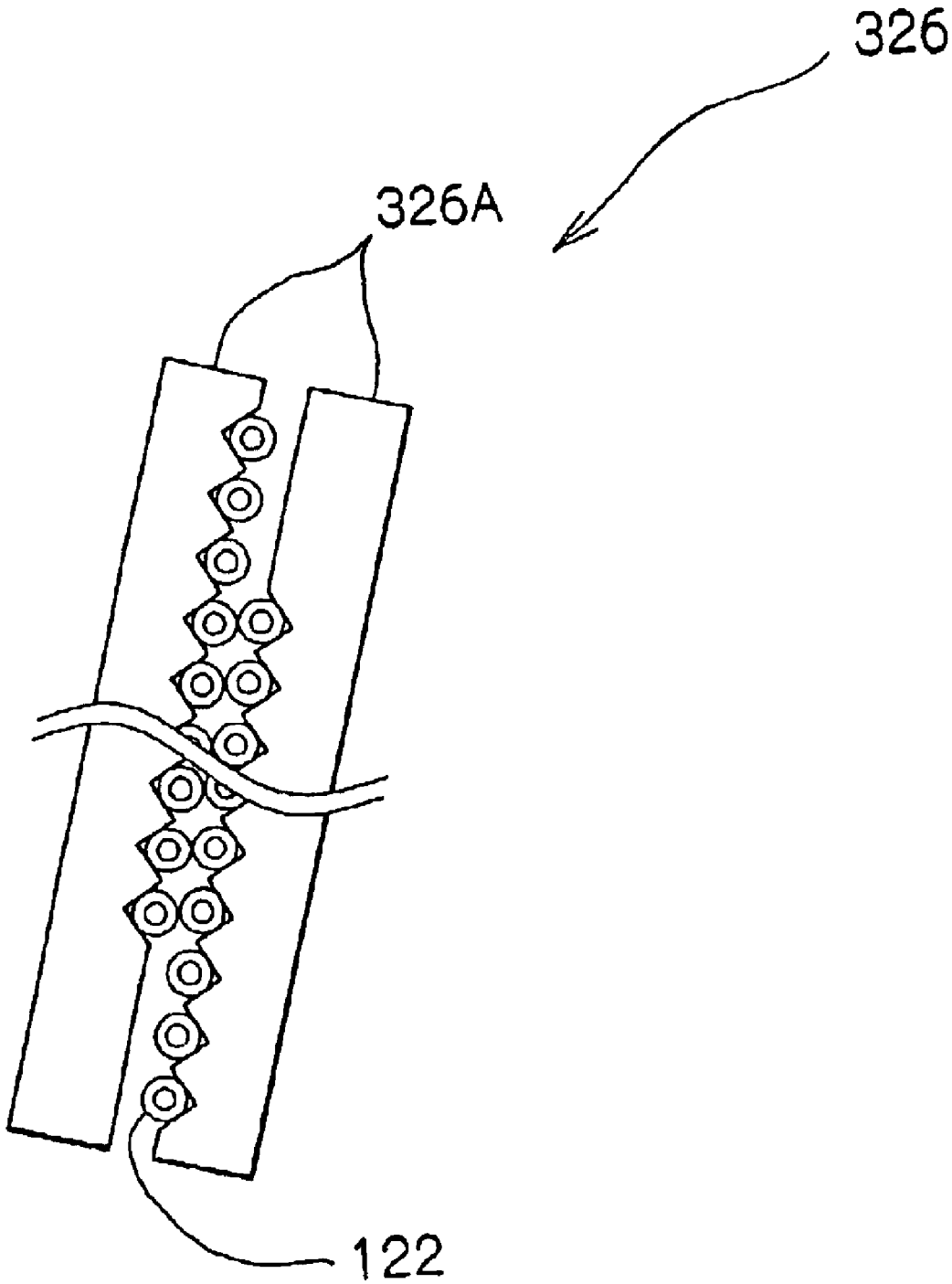
FIG. 10 is a detail drawing illustrating a fiberoptic source.

FIG. 10 illustrates the structure of the fiberoptic source 326 of FIG. 4A shown from the direction of arrow C. As shown in FIG. 10, the fiberoptic source 326 relating to the present embodiment has two bases 326A, each base 326A having, on one surface thereof, adjacently disposed V-shaped grooves whose total number is half the number of the semiconductor lasers 114. The bases 326A are disposed such that their surfaces having the V-shaped grooves thereon face each other. Into each V-shaped groove, the other end of each fiber cable 122 is fitted. Accordingly, a plurality of laser beams emitted from the semiconductor lasers 114 are simultaneously outputted from the fiberoptic source 326 at predetermined intervals.

As shown in FIGS. 4A and 4B, an internally threaded bracket 328 is mounted at the side surface of the moving stage 320. An externally threaded shaft 330, extending parallel to the sliding direction of the moving base, is screwed into the bracket 328. Ends of the shaft 330 are respectively supported by brackets 332 and 334.

One end of the shaft 330 is connected to a driving shaft of a pulse motor 338 mounted on a bracket 336. The shaft 330 is rotatingly driven by the pulse motor 338, whereby the internally threaded bracket 328 moves along the shaft 330.

Thus, the moving stage 320 is movable in the direction of the optical axis by the driving force of the pulse motor 338, whereby the focal length can be adjusted.

After the printing plate precursor 12 has been scan-exposed, the rotating drum 16 temporarily stops at the position where the trailing end chuck 36 faces the trailing end chuck mounting/dismounting unit 32, and the trailing end chuck 36 is removed from the rotating drum 16. Thus, the trailing end of the printing plate precursor 12 is released.

Thereafter, the rotating drum 16 is rotated in the direction of arrow B, whereby the printing plate precursor 12 is discharged trailing end first to the discharging guide 22 along a direction tangential to the rotating drum 16 and conveyed to a developing apparatus for development.

Figure 5:
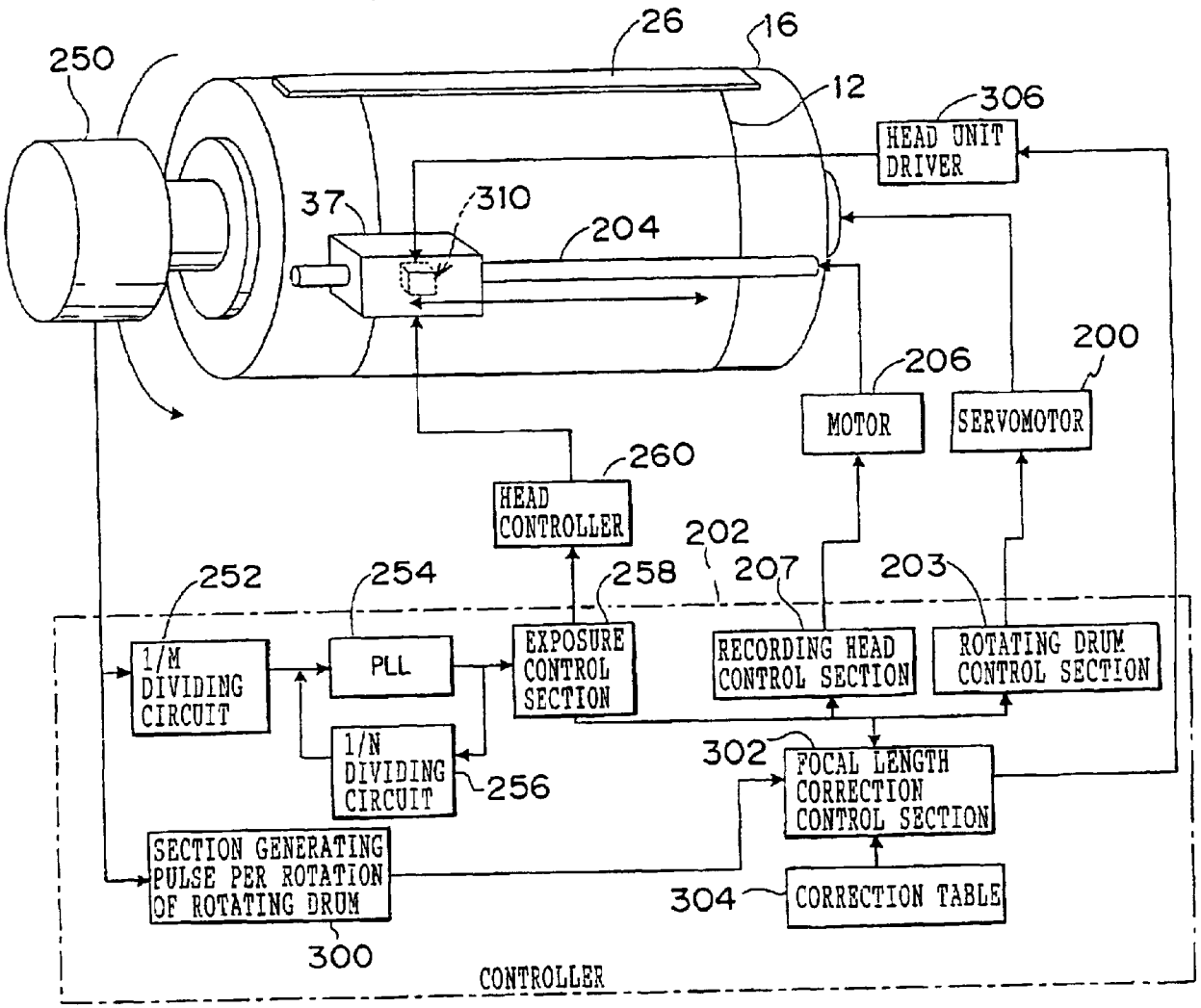
FIG. 5 is a block diagram illustrating a control system for controlling image recording in the invention.

FIG. 5 illustrates a control system that controls rotation of the rotating drum 16, movement of the recording head 37, image recording by the recording head 37 based on image signals, and focal length correction.

The rotating drum 16 is rotatingly driven by a servomotor 200 connected to one end of the shaft of the rotating drum 16. The rotational speed of the servomotor 200 is controlled on the basis of drive signals outputted from a rotating drum control section 203 in a controller 202.

The recording head 37 is moved parallel to the axis of the rotating drum 16 when an externally threaded shaft 204 in a ball screw mechanism is rotated by a motor 206. The rotational speed of the motor 206 is controlled on the basis of drive signals outputted from a recording head control section 207 in the controller 202.

A rotary encoder 250 is mounted on the other end of the shaft of the rotating drum 16. The rotary encoder 250 outputs pulse signals, i.e., reference position signals, in accordance with the rotation of the rotating drum 16. The reference position signals are inputted into a 1/M dividing circuit (frequency demultiplier or frequency divder) 252 and a pulse generating section 300 that generates one pulse signal per rotation of the rotating drum 16.

The 1/M dividing circuit 252 divides (demultiplies) the frequency of the inputted pulse signals into 1/M and outputs the results into a phase locked loop (PLL) circuit 254. In the PLL circuit 254, the 1/M-divided pulse signals are fed back via a 1/N dividing circuit 256, and controlled so that the phases of the 1/M-divided pulse signals and the 1/N-divided pulse signals correspond. Accordingly, the PLL circuit 254 outputs the pulse signals, which have obtained by multiplying the input 1/M-divided pulse signals by N/M, to an exposure control section 258 as image writing clock pulse signals.

The exposure control section 258 reads out image data from an image data buffer (not shown) in accordance with the image writing clock pulse signals, and controls, via a LD driver circuit (now shown) provided on the LD driver substrate 120, a head controller 260 to emit a light beam from the head unit 310 of the recording head 37.

It should be noted that the exposure control section 258 is also connected to the recording head control section 207 and to the rotating drum control section 203, and drivingly controls the rotating drum 16 and the recording head 37 synchronously with the output of the image data.

In the first embodiment, the exposure control section 258 is also connected to a focal length correction control section 302. The pulse signals generated per rotation of the rotating drum 16 by the pulse generating section 300 are inputted to the focal length correction control section 302 and used to determine focal length correction timing.

Because the printing plate precursor 12 is held on the rotating drum 16 by the leading end chuck 26 and the trailing end chuck 36, there are on the peripheral surface of the rotating drum 16 non-image recording areas including at least areas at which the leading end chuck 26 and the trailing end chuck 36 are disposed. The focal length correction control section 302 detects the non-image recording areas, reads out correction data from a correction table 304, and drives the pulse motor 338 (see FIGS. 4A and 4B) via a head unit driver 306 to move the moving stage 320 (see FIGS. 4A and 4B) of the head unit 310.

Figure 6:
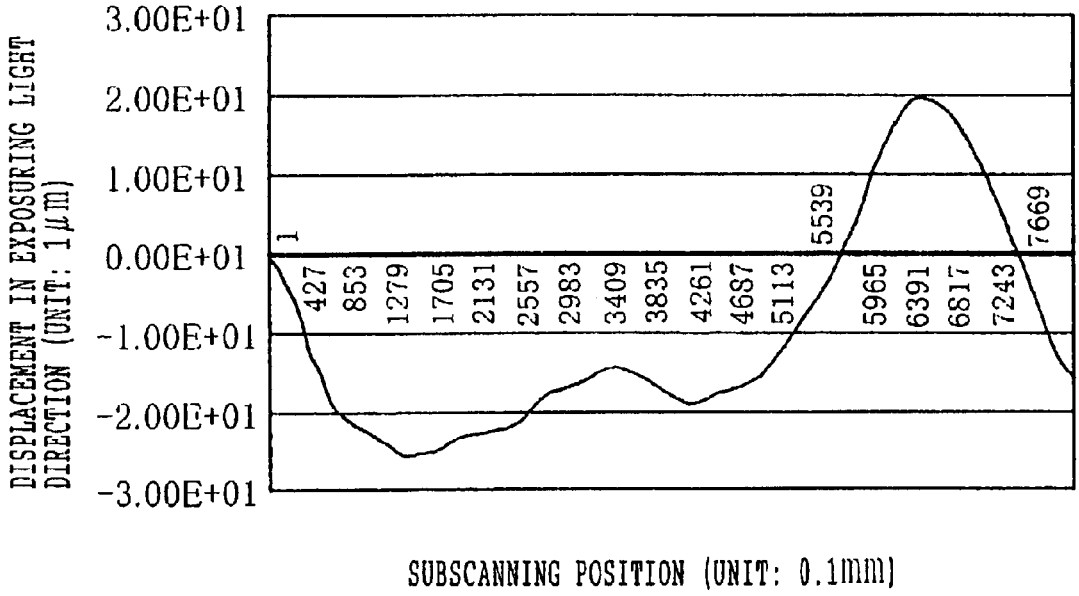
FIG. 6 is a graph which shows the characteristics of traveled amount of the recording head and displaced amount of the focal length stored in the correction table.

FIG. 6 shows an example in graph form of data stored in the correction table 304, with the amount of correction in response to the traveling amount of the recording head 37 being stored in the correction table 304. The data is created in advance through precise measurement using, for example, a highly accurate measuring device after the device 10 has been assembled. For example, the focal length can be corrected per single rotation of the rotating drum 16 using the data.

Operation of the first embodiment will now be explained.

First, the printing plate precursor 12 is placed on the feeding guide 20 manually, or automatically using, for example, an automatic sheet feeder.

The printing plate precursor 12 placed on the feeding guide 20 is supported relatively roughly, with little attention paid to the exact position and inclination of the printing plate precursor 12 with respect to the feeding guide 20. The pusher unit 66 pushes the printing plate precursor 12 closer to a predetermined temporary position. Because the printing plate precursor 12 abuts against at least two pressing portions, the inclination of the printing plate precursor 12 is corrected while the printing plate precursor 12 is pushed.

When the printing plate precursor 12 is conveyed to the rotating drum 16, the printing plate precursor 12 abuts against and is temporarily aligned by the aligning pins 74 positioned on the end of the feeding guide 20 near the rotating drum 16.

The pressing portion 86 of the widthwise pusher unit 84 is then moved such that the printing plate precursor 12 abuts against the aligning pins 94, which are predisposed at predetermined positions on the basis of the size of the printing plate precursor 12, and is temporarily aligned in the width direction.

After the printing plate precursor 12 is temporarily aligned and the aligning pins 74 are retracted to their retracted positions, the pressing portions 68 advances the printing plate 12 towards the rotating drum 16 until it abuts the pair of reference pins 100 and 102 disposed on the rotating drum 16. Accordingly, the leading end of the printing plate precursor 12 is properly aligned and inclination of the printing paper 12 is rectified.

Figure 3:
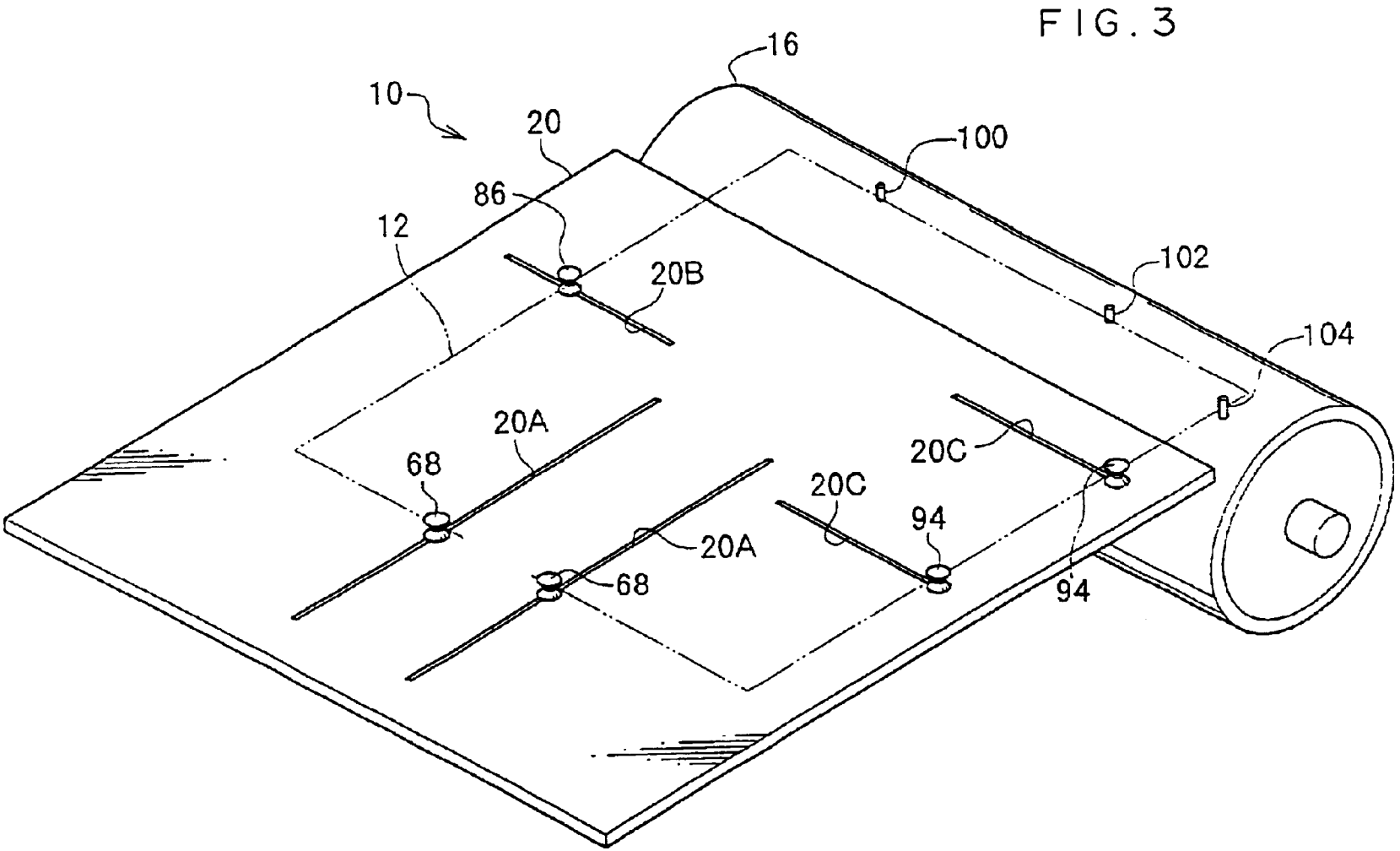
FIG. 3 is a perspective view of the conveyance guide unit, with the discharging guide having been removed therefrom and the printing plate precursor being aligned at a predetermined position.

Then, the pressing portion 86 of the widthwise pusher unit 84 moves the printing plate precursor 12 widthwise until it abuts against the reference pin 104. Since the printing plate precursor 12 has been substantially aligned in the width direction by the aligning pins 94 (i.e., the temporary alignment shown in FIG. 2), the pressing portion 86 corrects positional error arising from slight shifting of the printing plate precursor 12 from the temporary position. Accordingly, the printing plate precursor is aligned properly with respect to the rotating drum 16, as shown in FIG. 3.

After the printing plate precursor 12 is fed to the drum 16 and properly aligned, the printing plate precursor 12 is wound tightly around the peripheral surface of the rotating drum 16 and held by the leading end chuck 26 and the trailing end chuck 36, whereby preparation for exposure is complete.

Exposure is initiated by the image data being read and the light beam being emitted from the recording head 37. While the rotating drum 16 is rotated at a high speed (main scanning), the recording head 37 moves in the axial direction of the rotating drum 16 to scan-expose the printing plate precursor 12. Scan-exposure control will be described later.

When the printing plate precursor 12 has been exposed, the conveyance guide unit 18 is switched so that the discharging guide 22 is moved towards and corresponded to the rotating drum 16. The printing plate precursor 12 wound around the rotating drum 16 is then discharged to the discharging guide 22 in a direction tangential to the rotating drum 16, whereby the printing plate precursor 12 is fed to the discharging guide 22.

After the printing plate precursor 12 is fed to the discharging guide 22, the conveyance guide unit 18 is switched so that the discharging guide 22 is directed to a discharge port (not shown) through which the printing plate precursor 12 is discharged. The printing plate precursor 12 is subsequently developed in a developing apparatus disposed downstream from the discharge port.

Control of the image signal output during scan-exposure control will now be described.

When the rotating drum 16 rotates, the rotary encoder 250 outputs pulse signals in accordance with that rotation, and the pulse signals are inputted into the 1/M dividing circuit 252. Here, the value M in the 1/M dividing circuit 252 is set by an order from the exposure control section 258 based on the necessary resolution. The PLL circuit 254 and the 1/N dividing circuit 256 control the 1/M-divided pulse signals so that the phases of the 1/M-divided pulse signals and the 1/N-divided pulse signals correspond. It should be noted that the value N in the 1/N dividing circuit 256 is also set by an order from the exposure control section 258.

As a result, image writing clock pulse signals at a frequency of required resolution are outputted by the PLL circuit 254 to the exposure control section 258, based on the pulse signals outputted from the rotary encoder 250.

The exposure control section 258 controls the head controller 260 to transmit the image data to the light source unit 110, and carries out image recording synchronously with the recording head control section 207 and the rotating drum control section 203.

In the first embodiment, the focal length of the light beam emitted from the head unit 310 is properly corrected during the image recording.

Figure 7:
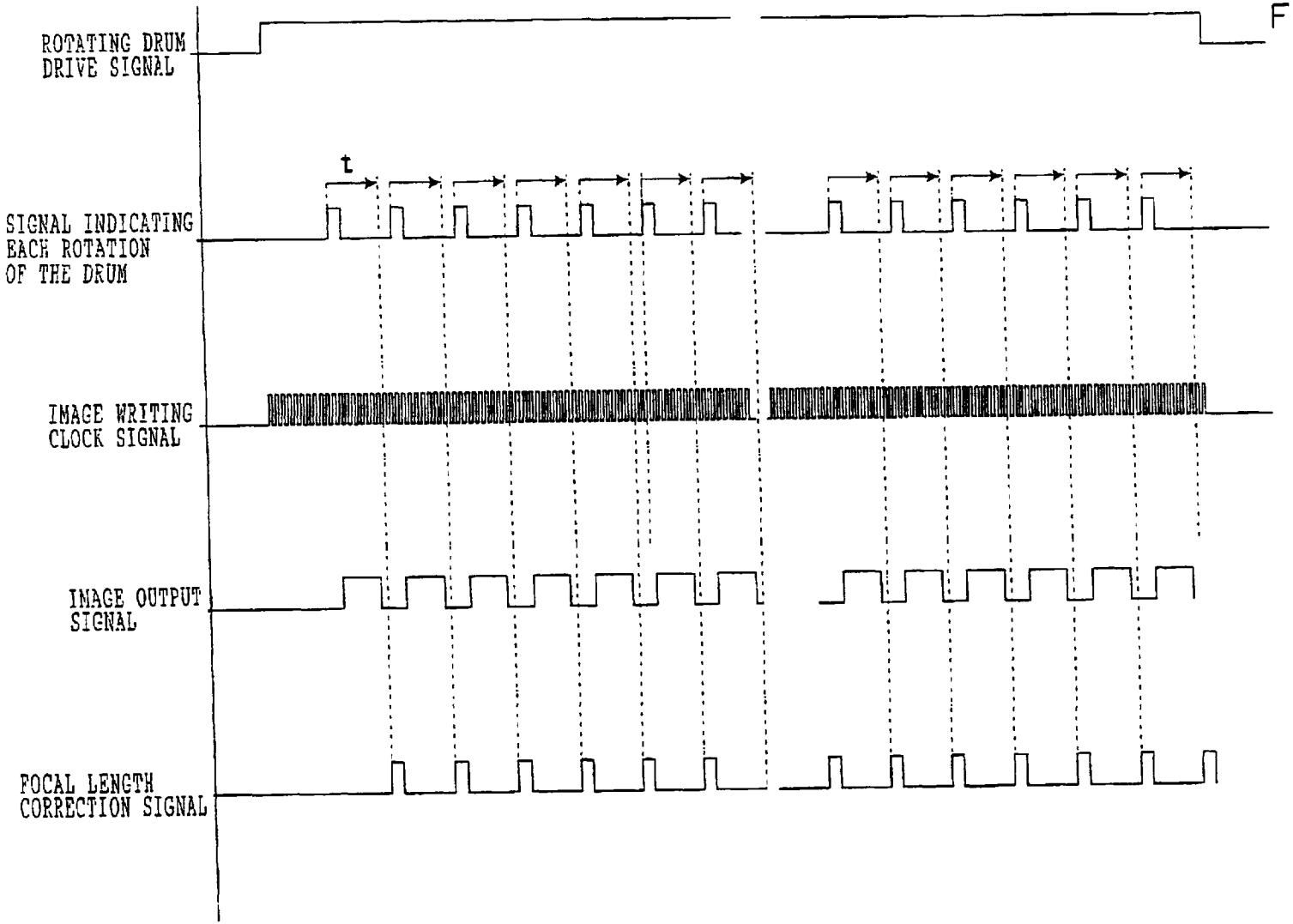
FIG. 7 is a timing chart that shows the relationship between signals used for correcting the focal length.

The correction procedure will be described referring to the correction timing chart of FIG. 7.

The pulse signals from the rotary encoder 250 are also inputted into the pulse generating section 300, where signals per rotation of the rotating drum 16 are generated. Namely, the signal indicates one pulse per rotation of the rotating drum 16, while the rotating drum 16 is rotating at a predetermined speed, and a predetermined period from the rising of the pulse corresponding to non-image recording area on the rotating drum 16. A focal length correction signal is outputted during this period (i.e., the period between the rising of the signal indicating one pulse per rotation of the rotating drum 16 and the end of period t in FIG. 7).

Synchronously with the output of the focal length correction signals, correction data that is based on the traveling position of the recording head 37 at that time is read out from the correction table 304, and the pulse motor 338 is driven by the head unit driver 306.

The amount of displacement in the position of the recording head 37 relative to the rotating drum 16 is measured using a highly accurate measuring device after the device 10 has been assembled, and the correction value therefor is computed and stored in the correction table 304. Accordingly, it is unnecessary to detect displacement of the focal length in real time during scan-exposure.

The shaft 330 is drivingly rotated by the pulse motor 338 so that the moving stage 320 moves in the direction of the optical axis, whereby the focal length can be changed.

In the first embodiment, displacement of the focal position of the light beam emitted from the recording head 37 in accordance with the traveling amount of the recording head 37 in the axial direction of the rotating drum 16 is measured in advance after the device is assembled. Correction data for compensation of the displacement is created from the measured amount of displacement and is stored in the correction table 304. At the time of image recording, the focal length is corrected by reading out the correction data from the correction table 304 in accordance with the traveling amount of the recording head 37 and by the pulse motor 338 moving the moving stage 320 in the direction of the optical axis. It is therefore unnecessary to employ auto-focus equipment to detect in real time and correct the relative position of the recording head 37 with respect to the rotating drum 16. Moreover, slight displacement of the focal point, which may compromise image quality, can be compensated with a device having a simple structure.

Second Embodiment

A second embodiment of the invention will now be described. Components the same as those in the first embodiment are denoted by the same reference numerals.

Figure 8A:
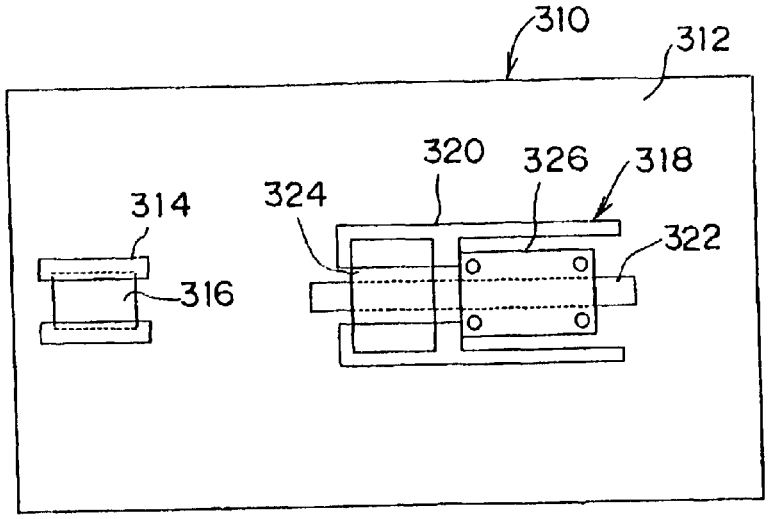
FIG. 8A is a plan view of a head unit mounted on a recording unit relating to a second embodiment of the invention.
Figure 8B:
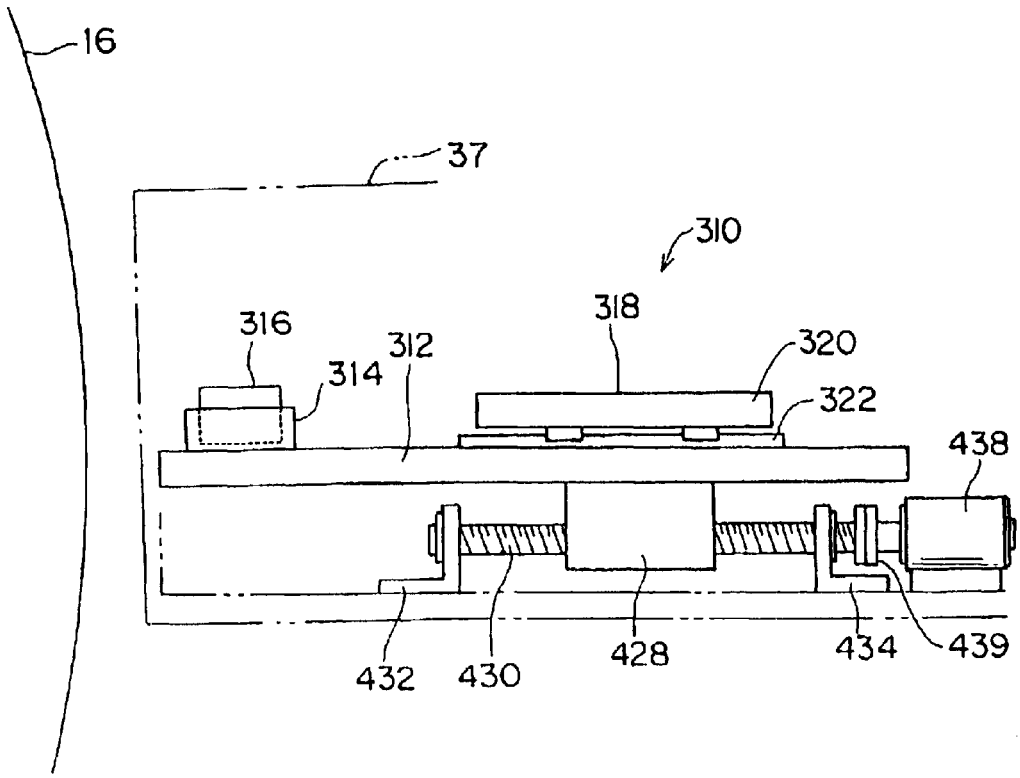
FIG. 8B is a side view of the head unit.

FIGS. 8A and 8B illustrate in detail the structure of the head unit 310 mounted on the recording head 37 relating to the second embodiment.

The head unit 310 includes the base 312 on which the condenser lens 316 is fixedly attached via the bracket 314 in the vicinity of the end of the base 312 disposed near the rotating drum 16. Light emitted from the light-emitting unit 318 enters the condenser lens 316 and is focused on the image recording surface of the printing plate precursor 12 wound around the rotating drum 16.

As in the first embodiment, the light-emitting unit 318 includes the moving stage 320 that is smoothly slidable on the rail 322 with respect to the base 312. The moving stage 320 is thus movable with respect to the base 312 towards and away from the rotating drum 16 to correct focal length. In the second embodiment, however, the focal length, and thus the position of the recording head, is not changed.

The collimator lens 324 is disposed on the moving stage 320 so as to face the condenser lens 316, and the fiberoptic source 326 is disposed adjacent to the collimator lens 324. The fiberoptic source 326 emits light that has been guided to the fiberoptic source 326 via the fiber cable 122 from the light source unit 110 provided separately from the recording head 37.

An internally threaded block 428 is mounted at a back surface (i.e., undersurface) of the base 312. An externally threaded shaft 430, extending parallel to the base 312, is screwed into the block 428. Ends of the shaft 430 are respectively supported by brackets 432 and 434 that are secured to a bottom surface of the recording head 37.

One end of the shaft 430 is connected to a driving shaft of a pulse motor 438 via a coupling 439. The shaft 430 is rotatingly driven by the pulse motor 338, whereby the internally threaded block 428 moves along the shaft 430.

Thus, the focal position can be adjusted, without changing the focal length, by the driving force of the pulse motor 438 moving the entire head unit 310 in the direction of the optical axis.

In the second embodiment, because it is unnecessary to change the relative position of the optical unit comprising a plurality of lenses with respect to the rotating drum, there is no variation or deformation in the diameter of the beam irradiated onto the printing plate precursor 12 due to correction of the recording head position as in the first embodiment. In this manner, adverse effects on image quality resulting from correction of the recording head position can be minimized.

Although each embodiment of the present invention has been described in conjunction with using the compensation data stored in the correction table 304 without changes, the present invention is not limited thereto. A temperature detecting means may be disposed at or near the recording head 37 and a correction coefficient based on a temperature detected by the temperature detecting means may be added to the compensation data by the focal length correction control section 302.

That is, the temperature around the recording head 37 may change during operation of the device. If the temperature at or near the recording head 37 at the time of recording an image differs from the temperature determined in advance at the time of preparation of the compensation data, the compensation data may include error in accordance with the difference in the temperature.

In this case, to compensate the error, it is preferable to detect the temperature at or near the recording head 37 at the time of recording an image, and modify the compensation data using a correction coefficient based on the temperature detected by the temperature detecting means.

Specifically, as an example shown in FIG. 4A, a temperature detector 130 as a temperature detecting means is disposed at or near the recording head 37 (at the fiberoptic source 326 in the example of FIG. 4A). The temperature detector 130 is connected to the focal length correction control section 302 and the focal length correction control section 302 can detect the temperature around the temperature detector 130 at any time.

In this embodiment, the temperature readings detected by the temperature detector 130 at the time of preparation of the compensation data is stored in a nonvolatile memory (not shown).

Then, at the time of forming an image, the focal length correction control section 302 obtains the current temperature readings from the temperature detector 130, and modifies the compensation data using a correction coefficient in accordance with the difference between the obtained temperature readings and the temperature readings that has been stored in the nonvolatile memory. Examples of the method of modifying the compensation data using the correction coefficient includes the following: adding the correction coefficient to the compensation data, multiplying the compensation data by the correction coefficient, subtracting the correction coefficient from the compensation data, and dividing the compensation data by the correction coefficient.

The correction coefficient is a value which, by modifying the compensation data, compensates an error in accordance with the difference, and values obtained in advance through explanations using the device, through a simulation on a computer, and the like may be employed as the correction coefficient.

As described above, by modifying the compensation data using the correction coefficient in accordance with the temperature readings detected by the temperature detecting means, correction may be carried out further precisely.

Although the embodiments have been described in conjunction with providing the recording head 37 and the light source unit 110 separately, the present invention is not limited thereto. The light source unit 110 may also be disposed inside the recording head 37. In this embodiment, the same effects as those of the above-described embodiments can be obtained.

The present invention has an excellent effect in that variation in focal length due to fluctuation in the relative position of the recording head with respect to the rotating drum can be compensated without employing an auto-focus device or the like to detect in real time the focal point of the light beam.

What is claimed is:

1. A device for recording an image on a sheet-like recording material in accordance with image data, the device comprising:

a rotatably supported drum including a peripheral surface on which the sheet-like recording material is wound;

a recording head including an optical unit that receives the image data and irradiates the sheet-like recording material with a light beam modulated on the basis of the image data to record an image on the sheet-like recording material, the recording head disposed facing the peripheral surface of the drum and movable in the axial direction of the drum;

a traveling amount detector for detecting a traveling amount of the recording head in the axial direction thereof from a predetermined position;

a memory for storing data for compensating for displacement of the optical unit in the direction of the optical axis in correspondence with the traveling amount of the recording head; and a focal point adjusting mechanism for adjusting the focal point of the light beam by moving at least a part of the optical unit included in the recording head in the direction of the optical axis, wherein the focal point adjusting mechanism corrects the focal point based on the traveling amount of the recording head detected by the traveling amount detector, and on the data for compensating for displacement of the optical unit in the direction of the optical axis stored in the memory, in correspondence with the traveling amount of the recording head.

2. The device according to claim 1, wherein the traveling amount detector includes a rotational position detector for detecting the rotational position of the drum.

3. The device according to claim 2, wherein the rotational position detector includes a rotary encoder that is connected to the drum and outputs a signal for each predetermined number of rotations of the drum.

4. The device according to claim 1, wherein the traveling amount detector outputs a signal for each predetermined number of rotations of the drum and based on the signal, computes the traveling amount of the recording head in the axial direction thereof.

5. The device according to claim 1, wherein the data for compensating for displacement of the optical unit in the direction of the optical axis and stored in the memory in correspondence with the traveling amount of the recording head, is measured and stored in the memory before commencement of image recording.

6. The device according to claim 1, wherein the sheet-like recording material comprises a photosensitive material.

7. The device according to claim 1, wherein the drum includes a non-image recording area thereon.

8. The device according to claim 7, wherein the rotational position detector recognizes the non-image recording area on the drum based on the detected rotational position of the drum.

9. The device according to claim 7, wherein the focal point adjusting mechanism corrects the focal point when the recording head faces the non-image recording area on the drum.

10. The device according to claim 7, wherein the drum includes a holding member that holds the sheet-like recording material on the drum at least while recording, and the non-image recording area includes at least a portion of the holding member.

11. The device according to claim 1, wherein the optical unit comprises a light beam emitting source and at least one lens that is used for focusing the light beam emitted from the light beam emitting source on a surface of the sheet-like recording material on the drum.

12. The device according to claim 1, wherein the light beam emitting source comprises a fiber source that optically communicates with a light beam irradiating source.

13. The device according to claim 1, wherein the focal point adjusting mechanism adjusts the focal point by at least moving the position of the light beam emitting source relative to the drum in the direction of the optical axis.

14. The device according to claim 1, wherein the focal point adjusting mechanism adjusts the focal point by moving substantially the entire optical unit relative to the drum in the optical axis direction.

15. The device according to claim 1, further comprising temperature detector disposed at or near the recording head, wherein a correction coefficient based on a temperature readings detected by the temperature detector is used to modify the compensation data.

* * * * *